US010060606B2

(12) United States Patent
Lam

(10) Patent No.: US 10,060,606 B2
(45) Date of Patent: Aug. 28, 2018

(54) DETACHABLE ROD-LIKE DECORATIVE LIGHTING

(71) Applicant: Jiangmen Hongsen Electronic Lighting Co., Ltd., Jiangmen, Guangdong Province (CN)

(72) Inventor: Su Io Lam, Jiangmen (CN)

(73) Assignee: JIANGMEN HONGSEN ELECTRONIC LIGHTING CO., LTD., Jiangmen, Guangdong (CN)

( * ) Notice: Subject to any disclaimer, the term of this patent is extended or adjusted under 35 U.S.C. 154(b) by 31 days.

(21) Appl. No.: 15/472,433

(22) Filed: Mar. 29, 2017

(65) Prior Publication Data

US 2018/0209617 A1 Jul. 26, 2018

(30) Foreign Application Priority Data

Jan. 22, 2017 (CN) ..... 2017 1 0054071

(51) Int. Cl.

| | |
|---|---|
| ***F21V 19/04*** | (2006.01) |
| ***F21V 21/00*** | (2006.01) |
| ***F21V 23/04*** | (2006.01) |
| ***F21V 3/02*** | (2006.01) |
| *F21W 121/00* | (2006.01) |

(52) U.S. Cl.

CPC ..... *F21V 19/04* (2013.01); *F21V 3/02* (2013.01); *F21V 21/00* (2013.01); *F21V 23/0414* (2013.01); *F21W 2121/00* (2013.01)

(58) Field of Classification Search

CPC ..... F21V 19/00; F21V 19/04

See application file for complete search history.

(56) References Cited

U.S. PATENT DOCUMENTS 5,091,834 A * 2/1992 Kao ..... F21S 6/003 362/410

9,050,929 B2 * 6/2015 Clifford ..... B60Q 1/2657

* cited by examiner

*Primary Examiner* — Robert May

(74) *Attorney, Agent, or Firm* — Andrew D. Dorisio; King & Schickli, PLLC

(57) ABSTRACT

A detachable rod-like decorative lighting, comprises a rod and a fancy lamp detachably connected to the top of the rod, wherein the rod comprises an outer pipe and an inner shell adapted to be inside the outer pipe; the outer pipe is a single body or consists of at least two pipes integrally formed with one another by axial connection; the inner shell is provided at the top thereof with a coaxial hole; the fancy lamp is provided at the bottom thereof with a plug connected to the top of the outer pipe by insertion and the plug is provided with a coaxial column corresponding to the coaxial hole for electric connection; and the outer pipe is provided at the top and the bottom thereof with connecting structures, respectively, for quickly matching and being fixed to the fancy lamp and the inner shell.

8 Claims, 5 Drawing Sheets

DETACHABLE ROD-LIKE DECORATIVE LIGHTING

CROSS REFERENCE TO RELATED APPLICATIONS

This disclosure claims the benefit of priority of CN201710054071.3 filed in 2017, the content of which is hereby incorporated by reference.

FIELD OF THE INVENTION

The present disclosure relates to a decorative lighting, and more particularly, to a detachable rod-like decorative lighting.

BACKGROUND OF THE INVENTION

Decorative lightings are commonly used in daily life today, for example, a handheld decorative lighting is designed as a cane or a rod body, which allows a user to switch on light sources inside the lighting by controlling switches or buttons thereof to obtain an effect like a magic wand, magic stick and the like by emitting rays of light. Typically, the existing lighting structure is formed of an assembled non-detachable body, which is provided at the top thereof with an irreplaceable molded lamp. Thus this lighting is designed only for a specific festival scene or specific subject matter. The molded lamp can't be changed or replaced for more applications. A handheld portion of the rod body is provided to accommodate batteries, electronic components, wires, etc., so the rod body is usually integrally formed of two separating parts by combining them in a direction along an axis of the rod body, which must leave two axial seams on both sides thereof. Hence, due to the seams on the rod body, transfer printing or paper pasting can't be well applied on the surface of the rod body, and thus the rod body has a poor performance in peripheral decoration.

SUMMARY OF THE INVENTION

In order to solve the problem mentioned in the Background section above, the present disclosure provides, among other things, a detachable rod-like decorative lighting, which is well ornamental and flexibly used The present disclosure adopts following technical solutions to solve the problem mentioned in the Background section above.

In one aspect, the present disclosure is directed to a detachable rod-like decorative lighting, comprising: a rod; and a fancy lamp detachably connected to a top of the rod; wherein the rod comprises an outer pipe; and an inner shell adapted to locate inside the outer pipe; wherein the outer pipe is a single body or consists of at least two pipe portions integrally formed with one another by axial connection; the inner shell is provided at the top thereof with a coaxial hole; the fancy lamp is provided at the bottom thereof with a plug connected to the top of the outer pipe by insertion, and the plug is provided with a coaxial column matching with the coaxial hole for electric connection; and the outer pipe is provided at the top and the bottom thereof with connecting structures, respectively, for matching and engaging with the fancy lamp and the inner shell.

Connecting slots are provided at an inner wall of openings at both the top and the bottom of the outer pipe, the connecting slots are first extended in an axial direction along the axis of the outer pipe and then in a circumferential direction along a radial section of the outer pipe, and the plug is provided at outer wall thereof with a protruding block correspondingly connected to the connecting slot at the top of the outer pipe by locking, the inner shell is provided at the bottom thereof with a connecting block correspondingly connected to the connecting slot at the bottom of the outer pipe by locking.

The outer pipe is provided at outer wall thereof with a button assembly corresponding to the inner shell and a mounting groove for fixing of the button assembly.

The outer pipe consists of at least two pipe portions by axial connection, the at least two pipe portions comprise an upper pipe and a lower pipe, in which the upper pipe of the outer pipe is transparent, semitransparent or non-transparent.

The inner shell consists of separate portions axially connected to one another, wherein the separate portions comprise an upper portion and a lower portion.

The lower portion of the inner shell is provided at the upper end thereof with a shoulder correspondingly covering the lower end of the upper portion of the inner shell, and the upper portion of the inner shell is provided at the lower end thereof with a protruding connector with a radial connecting hole, while the lower portion of the inner shell is provided inside thereof with a connecting column passing through the connector.

The upper pipe of the outer pipe is provided at the bottom thereof with a shoulder configured to be correspondingly fitted into an inner wall of the lower pipe of the outer pipe which is also provided with a connecting slot used to connected to a protrusion provided on the shoulder by locking.

The present disclosure is advantageous in that: the decorative lighting with the fancy lamp which can be quickly installed, detached and replaced allows users to easily replace the fancy lamp and use the decorative lighting in different festival scenes or subject matters, which improves entertainment and convenience when using the decorative lighting. Meanwhile, the outer pipe can be decorated easily by paint spraying, transfer printing or paper pasting to facilitate decoration and entertainment as the outer pipe hasn't any joint for axial extension.

BRIEF DESCRIPTION OF THE DRAWINGS

The conception, specific structure and resulting technical effects of the present disclosure will be clearly and completely described hereunder with reference to the embodiments and drawings, to sufficiently understand the objects, solutions and effects of the present disclosure. However, it should be understood that the present disclosure is not limited to the precise arrangements and instrumentalities shown in the drawings, wherein.

DETAILED DESCRIPTION OF THE EMBODIMENTS

In order to solve the problem mentioned in the Background section above, the present disclosure provides, among other things, a detachable rod-like decorative lighting, which is well ornamental and flexibly used.

Figure 1:
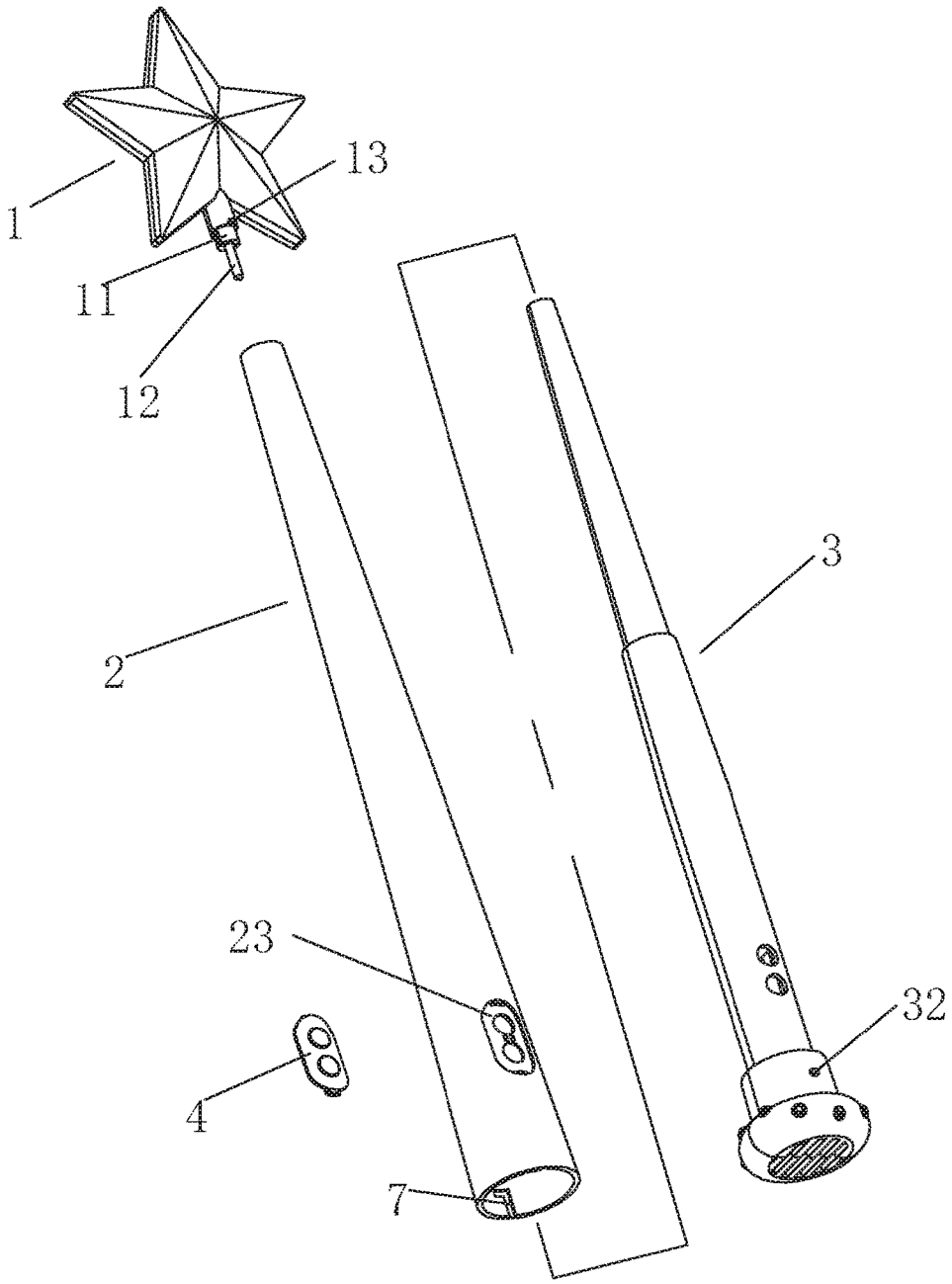
FIG. 1 is an exploded view of an installation structure of an embodiment of the detachable rod-like decorative lighting according to the present disclosure.
Figure 2:
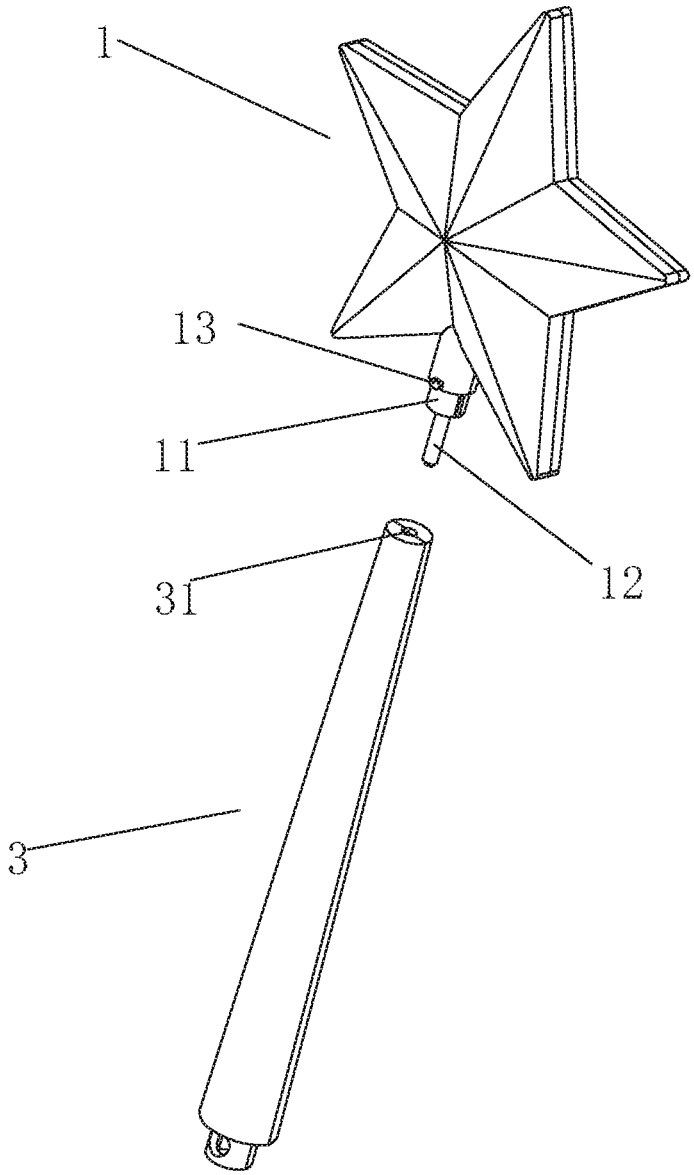
FIG. 2 is an exploded view of the embodiment, which shows an installation structure of a fancy lamp and a upper portion of an inner shell.

Referring to FIGS. 1 and 2, an embodiment of a detachable rod-like decorative lighting according to the present disclosure, comprises a rod and a fancy lamp 1 (i.e. a lamp in customized shape or appearance) detachably connected to the top of the rod, wherein the rod comprises an outer pipe 2 and an inner shell 3 adapted to locate inside the outer pipe 2 for housing one or more electronic components, one or more batteries, wires, one or more light sources, etc. The outer pipe 2 is a single body (or referred as one-piece body) without any joint or seam extended along the outer pipe 2 in axial direction, thus it cannot be took apart along an axial seam or gap, and thus the inner shell 3 can only be mounted into the outer pipe 2 from an end opening provided on one or both ends of the outer pipe 2. The inner shell 3 is a member assembled from multiple parts, wherein the inner shell 3 has a shape corresponding to the outer pipe 2. The inner shell 3 is provided at the top thereof with a coaxial hole 31 and a connecting socket correspondingly inside the coaxial hole 31. The fancy lamp 1 is provided at the bottom thereof with a plug 11 connected to the top of the outer pipe 2 by insertion. The plug 11 is provided with a coaxial column 12 matching with the coaxial hole 31, wherein the coaxial column 12 may be or comprises an electrical connector for electric connection. The outer pipe 2 is provided at the top and the bottom thereof with connecting structures, respectively, for quickly matching and engaging with the fancy lamp 1 and the inner shell 3. The connecting structures can be a form of locking or clamping connection, for example, a cooperative connection of a hook and a slot, or can be a fastener connection, for example a threaded connection. The fancy lamp 1 can be designed with a star-like, circular or other shape, in transparent or non-transparent. Besides, the fancy lamp 1 can be provided inside thereof with one or more light sources and electrically connected to the coaxial column 12, to be connected to the one or more electronic components, the one or more batteries, etc. inside the inner shell 3 by wires, as the inner shell 3 can be quickly connected to the coaxial column 12 by the connecting socket inside the coaxial hole 31 at the top of the inner shell 3. Since the fancy lamp 1 can be designed as different styles, profiles or shapes according to different festivals or themes, the rod-like decorative lighting according to the present disclosure allows directly and quickly replacing and using of the fancy lamp 1. Meanwhile, the outer pipe 2 can be a long-tapered or cylindrical shape or other shapes, and can be decorated easily by paint spraying, transfer printing or paper pasting as the outer pipe 2 hasn't any joint or seam. Furthermore, such seamless design can effectively improve efficiency of product assembling and save time in the manufacturing process.

As shown in FIG. 1-4, connecting slots 7 are provided at an inner wall of the openings at both the top and the bottom of the outer pipe 2. The connecting slots 7 can be L-shaped, reverse T-shaped, curving or other shapes suitable for locking. In case of a L-shaped connecting slot 7, it extends first in an axial direction along the axis of the outer pipe 2 then in a circumferential direction along a radial section of the outer pipe 2. And the plug 11 is provided at outer wall thereof with a protruding block 13 to be correspondingly connected to the connecting slot 7 at the top of the outer pipe 2, by locking. In this case the fancy lamp 1 can be tightly connected to the outer pipe 2, by inserting the protruding block 13 into the connecting slot 7 and rotating the plug 11 until the protruding block 13 contacts or reach to an end of the connecting slot 7 in the circumferential direction. In the same way, the inner shell 3 is provided at the bottom thereof with a connecting block 32 (which can be fabricated as another protruding block 32) to be correspondingly connected to the connecting slot 7 at the bottom of the outer pipe 2, by locking. In this way the inner shell 3 can be tightly connected to the outer pipe 2, by axially inserting the connecting block 32 of the inner shell 3 into the connecting slot 7 and rotating the inner shell 3 until the connecting block 32 contacts or reach to an end of the connecting slot 7 in the circumferential direction, after the inner shell 3 enters into the outer pipe 2 from the bottom thereof. Thus the connection of the fancy lamp 1 and the outer pipe 2 and the connection of the inner shell 3 and the outer pipe 2 are both easily operated.

Figure 3:
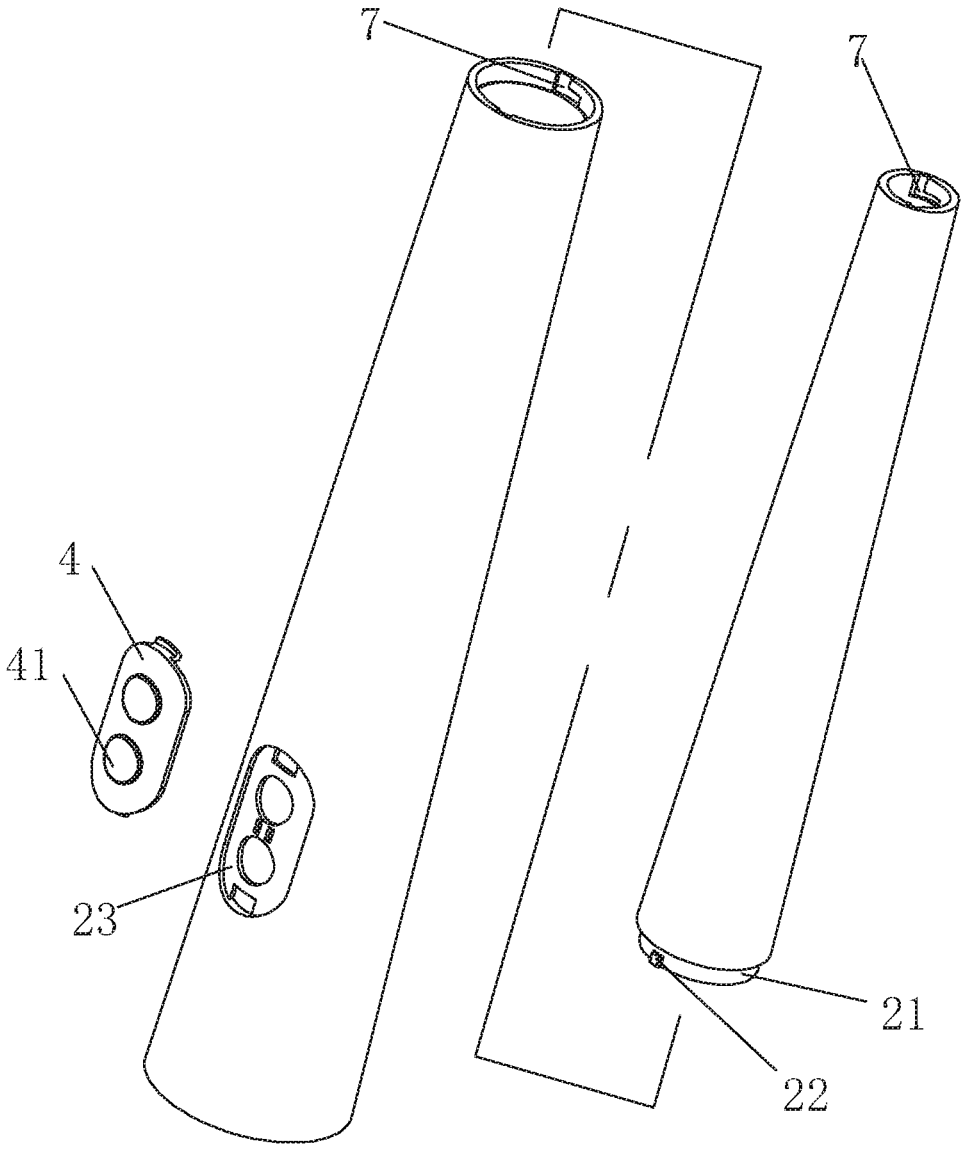
FIG. 3 is an exploded view of another embodiment, which shows an installation structure of an outer pipe with two axially connected sections.
Figure 4:
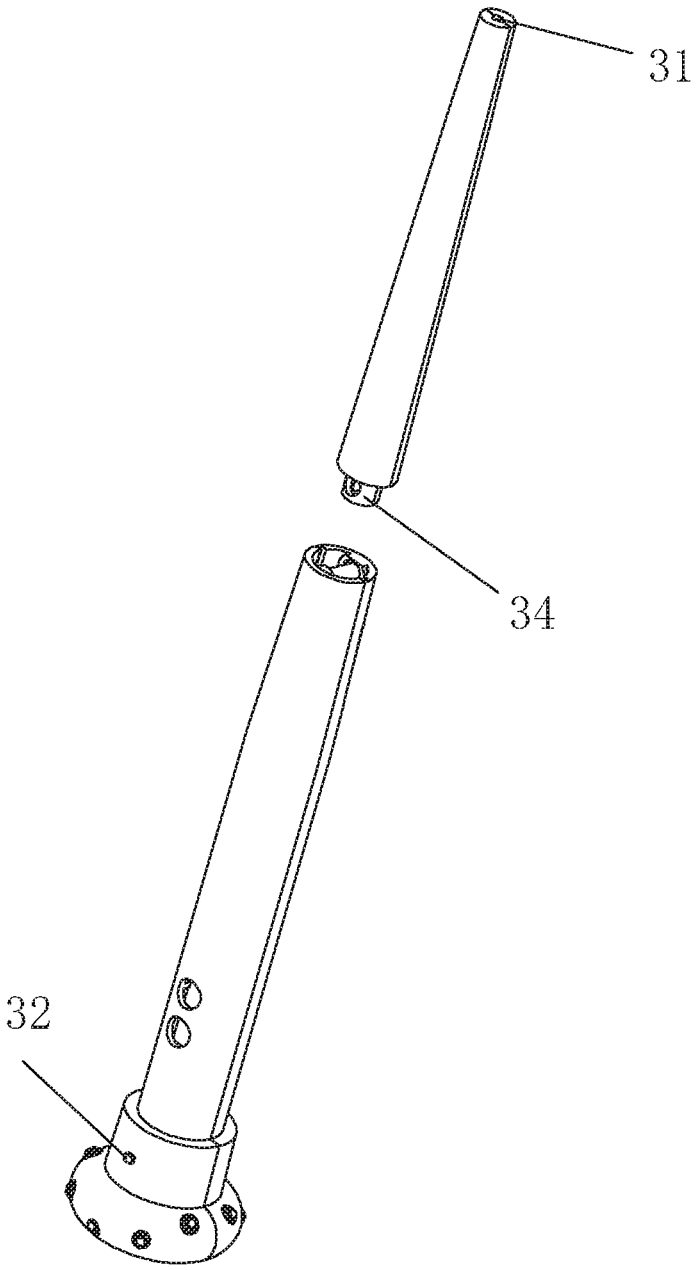
FIG. 4 is an exploded view of the embodiment, which shows an installation structure of the inner shell.

As shown in FIGS. 1, 3 and 4, the outer pipe 2 is provided at outer wall thereof with a button assembly 4, corresponding to electronic components in the inner shell 3 and corresponding to holes for housing buttons 41; and a mounting groove 23 for fixing of the button assembly 4. And the button assembly 4 is provided at the edge thereof with one or more hooks, which are correspondingly inserted into gaps at the edge of the mounting groove 23 and connected to inner wall of the outer pipe 2 by locking. The mounting groove 23 is provided with holes for housing buttons 41 of the button assembly 4, with one side of the buttons 41 tightly connected to inner side of the button assembly 4 by locking. Thus the mounting groove 23 and the button assembly 4 prevent the bottom of the buttons from interfering movement, operation or rotation of the inner shell 3 which locates closely inside the outer pipe 2. After being correctly mounted, button element(s) can be touched only if the button(s) is/are pressed.

As shown in FIG. 3, in a modified structure of another embodiment, the outer pipe 2 consists of at least two pipe portions correspondingly and integrally formed with one another by axial connection, such as an upper pipe and a lower pipe. The upper pipe of the outer pipe 2 can be transparent, semitransparent or non-transparent, and correspondingly, the inner shell 3 can be correspondingly provided at the top thereof with one or more light sources, one or more string lights or without any light source. When the inner shell 3 is provided at the top thereof with one or more string lights, they cooperate with a transparent part of the outer pipe 2 to light from the top of the inner shell 3 and emit through the upper pipe of the outer pipe 2 when being switched on, which has a gorgeous effect of simultaneously lighting with the fancy lamp 1.

As shown in FIG. 4, the inner shell 3 consists of separate portions axially connected to one another, i.e. an upper portion and a lower portion, so the upper portion thereof can be independently designed as a transparent shell in various shapes and correspondingly connected with the lower portion of the inner shell 3 to form a one-piece structure, in order to simplify manufacturing of parts. The lower portion of the inner shell 3 is provided at the upper end thereof with a shoulder correspondingly covering the lower end of the upper portion. The upper portion of the inner shell 3 is provided at the lower end thereof with a protruding connector 34 with a radial connecting hole, while the lower portion of the inner shell 3 is provided inside thereof with a connecting column passing through the connector 34 (preferably via the radial connecting hole). Furthermore, the transparent shell can be designed as a shape of a crystal shell, wherein one or more string lights or one or more light bars can be added to cooperate with the fancy lamp 1, such that the decorative lighting can be designed to has an emanative form/operable mode to produce a lighting effect like fireworks when being switched on.

As shown in FIG. 3, the upper pipe of the outer pipe 2 is provided at the bottom thereof with a shoulder 21 configured to be correspondingly fitted into an inner wall of the lower pipe of the outer pipe 2. The lower pipe of the outer pipe 2 is also provided with a connecting slot 7 used to connected to a protrusion 22 provided on the shoulder 21 by locking. Thus the connection of the upper and the lower pipes of the outer pipe 2, the connection of the fancy lamp 1 and the outer pipe 2 and the connection of the inner shell 3 and the outer pipe 2 are both quickly realized by cooperatively connection of a connecting slot 7 and a protrusion by locking. Same radial positions of each connecting slots 7 can be arranged from top to bottom of the outer pipe 2, so that positions of the connection of the fancy lamp 1 and the outer pipe 2 and the connection of the inner shell 3 and the outer pipe 2 can be easily determined.

Figure 5:
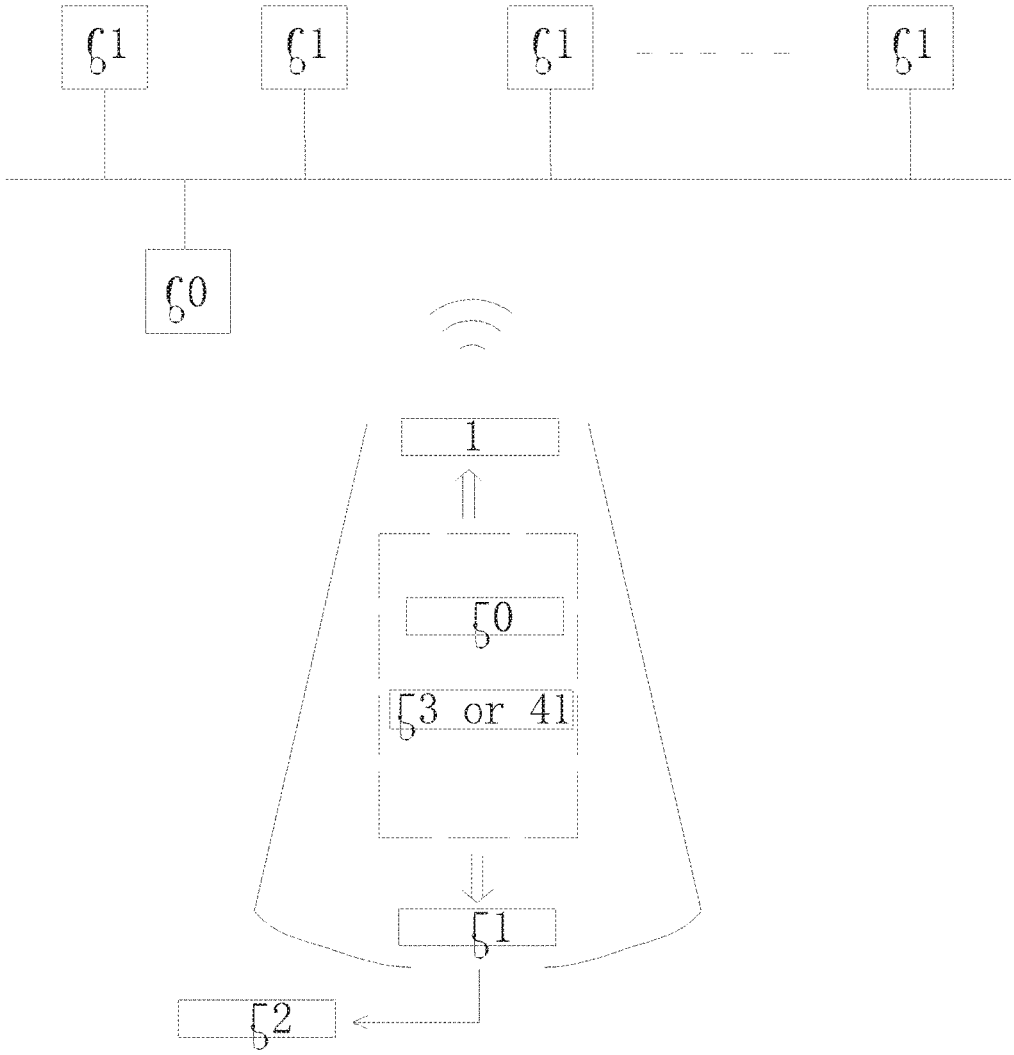
FIG. 5 is a diagram showing electronic inside the inner shell and a illustration of remote control, of an embodiment according to the present disclosure.

In another embodiment of the present disclosure, as shown in FIG. 5, the rod-like decorative lighting cooperates with a remotely and electrically controlled socket 60. In this case the inner shell 3 of the rod-like decorative lighting comprises a remote controlling circuit module 50 inside the inner shell 3, a loudspeaker 51, and an opening 52 corresponding to the loudspeaker for sound passing through. When the rod-like decorative lighting is operated by pressing the buttons 41 to emit light and make sound by the loudspeaker, the remote controlling circuit module 50 in the rod-like decorative lighting can be activated simultaneously and sends remote control signals to and controls the electrically controlled socket 60 to switch on or off, thus other decorative lightings 61 (such as other larger decorative lightings) connected to the electrically controlled socket 60 are switched on or off. And the inner shell 3 can be provided inside thereof with one or more IMUs, for example an acceleration sensor 53, as an alternative or a substitution to traditional button switches (such as buttons 41), such that the switching on/off for the rod-like decorative lighting itself and/or other decorative lightings remotely controlled by the rod-like decorative lighting can be done by waving or gestures. Such operation manner can improve entertainment and enjoyment for children. Additionally, lighting modes of the rod-like decorative lighting can be configured as one or more styles, such as twinkling, gradually brighten, gradually darken, etc., as needed. The outer pipe 2 can also be configured as a straight pipe, or a pipe with streaks on an outer wall, or other shapes, or configured separately with respect to the upper and the lower pipe thereof to have differences on each section. In a similar way, the upper portion of the inner shell 3 can also be separately designed as being transparent, streaky or concavoconvex, etc. And a coaxial column and socket can be cooperatively designed as a similar structure to a DC plug and socket, or a hardware structure having the same effect.

It should be understood that, as used herein, "first," "second," "third," etc., and "top" and "bottom" are arbitrarily assigned and are merely intended to differentiate between two or more panels, their positions, etc., as the case may be, and does not indicate any particular orientation or sequence. Furthermore, it is to be understood that the mere use of the term "first" does not require that there be any "second," and the mere use of the term "second" does not require that there be any "third," etc.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure. While apparatus and methods are described in terms of "comprising," "containing," or "including" various components or steps, the apparatus and methods also can "consist essentially of" or "consist of" the various components and steps. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted. From the foregoing description it will be understood by those skilled in the art that many variations or modifications in details of design, construction and operation may be made without departing from the present disclosure as defined in the claims.

It should be illustrated that, unless otherwise specifically stated, when some feature is referred to as being "fixed on" and "connected to" another feature, it can be directly fixed on and connected to another feature, or indirectly fixed on or connected to another feature. In addition, the descriptions of upper, lower, left and right used in the disclosure are only relative to a mutual location relationship of each component of the disclosure in the drawings.

Furthermore, unless otherwise defined, all technical and scientific terms used in the text have the same meaning as commonly understood by those skilled in the art. The terms used in the description are only for the purpose of describing particular embodiments instead of limiting the present disclosure. The term "and/or" used in the text includes any combination of one or more related and listed items.

It should be illustrated that in case of no conflict, the embodiments according to the present disclosure and the technical features in the embodiments may be combined with each other.

The invention claimed is:

1. A detachable rod-like decorative lighting, comprising:

a rod; and a fancy lamp detachably connected to a top of the rod;

wherein the rod comprises an outer pipe; and an inner shell adapted to locate inside the outer pipe;

wherein the outer pipe is a single body or consists of at least two pipe portions integrally formed with one another by axial connection; the inner shell is provided at the top thereof with a coaxial hole; the fancy lamp is provided at the bottom thereof with a plug connected to the top of the outer pipe by insertion, and the plug is provided with a coaxial column matching with the coaxial hole for electric connection; and the outer pipe is provided at the top and the bottom thereof with connecting structures, respectively, for matching and engaging with the fancy lamp and the inner shell.

2. The detachable rod-like decorative lighting of claim 1, wherein connecting slots are provided at an inner wall of openings at both the top and the bottom of the outer pipe, the connecting slots are first extended in an axial direction along the axis of the outer pipe and then in a circumferential direction along a radial section of the outer pipe, and the plug is provided at outer wall thereof with a protruding block correspondingly connected to the connecting slot at the top of the outer pipe by locking, the inner shell is provided at the bottom thereof with a connecting block correspondingly connected to the connecting slot at the bottom of the outer pipe by locking.

3. The detachable rod-like decorative lighting of claim 2, wherein the outer pipe is provided at outer wall thereof with a button assembly corresponding to the inner shell and a mounting groove for fixing of the button assembly.

4. The detachable rod-like decorative lighting of claim 1, wherein the outer pipe is provided at outer wall thereof with a button assembly corresponding to the inner shell and a mounting groove for fixing of the button assembly.

5. The detachable rod-like decorative lighting of claim 1, wherein the outer pipe consists of at least two pipe portions by axial connection, the at least two pipe portions comprise an upper pipe and a lower pipe, in which the upper pipe of the outer pipe is transparent, semitransparent or non-transparent.

6. The detachable rod-like decorative lighting of claim 5, wherein the inner shell consists of separate portions axially connected to one another, wherein the separate portions comprise an upper portion and a lower portion.

7. The detachable rod-like decorative lighting of claim 6, wherein the lower portion of the inner shell is provided at the upper end thereof with a shoulder correspondingly covering the lower end of the upper portion of the inner shell, and the upper portion of the inner shell is provided at the lower end thereof with a protruding connector with a radial connecting hole, while the lower portion of the inner shell is provided inside thereof with a connecting column passing through the connector.

8. The detachable rod-like decorative lighting of claim 5, wherein the upper pipe of the outer pipe is provided at the bottom thereof with a shoulder configured to be correspondingly fitted into an inner wall of the lower pipe of the outer pipe which is also provided with a connecting slot used to connected to a protrusion provided on the shoulder by locking.

* * * * *